US006443610B1

(12) United States Patent
Shechter et al.

(10) Patent No.: US 6,443,610 B1
(45) Date of Patent: Sep. 3, 2002

(54) PROCESSING PRODUCT COMPONENTS

(75) Inventors: Tal Shechter, Randolph, MA (US); Assaf Levin, Kiryat-Ata; Yehuda Aish, Kiryat-Tivon, both of (IL)

(73) Assignee: B.E.E. International, Migdal Ha'emek (IL)

( * ) Notice: Subject to any disclaimer, the term of this patent is extended or adjusted under 35 U.S.C. 154(b) by 0 days.

(21) Appl. No.: 09/220,138

(22) Filed: Dec. 23, 1998

(51) Int. Cl.[7] ..... B01F 13/00
(52) U.S. Cl. ..... 366/162.4; 366/173.1
(58) Field of Search ..... 366/336, 340, 366/162.4, 167.1, 176.1, 181.5, 159.1, 162.5, 173.1, 173.2, 174.1, 175.2, 176.2, 177.1, 162.3; 422/133, 135

(56) References Cited

U.S. PATENT DOCUMENTS

| | | | | |
|---|---|---|---|---|
| 1,496,345 A | | 6/1924 | Lichtenhaeler | 366/165.2 |
| 1,496,858 A | | 6/1924 | Knollenberg | |
| 1,593,762 A | | 7/1926 | Heitmann et al. | |
| 2,068,136 A | | 1/1937 | Hulbert | 252/6 |
| 2,312,639 A | * | 3/1943 | Gronemeyer | |
| 2,584,805 A | | 2/1952 | Leftwich | 60/39.05 |
| 2,692,764 A | * | 10/1954 | Hanson | 366/173.2 |
| 2,768,123 A | * | 10/1956 | Trusty et al. | 366/162.4 |
| 2,882,025 A | | 4/1959 | Loo | 259/4 |
| 3,153,578 A | | 10/1964 | Taylor | 23/260 |
| 3,251,653 A | * | 5/1966 | Aditya | |
| 3,459,407 A | | 8/1969 | Hazelhurst et al. | 259/4 |
| 3,476,521 A | | 11/1969 | Wise | 23/285 |
| 3,684,884 A | * | 8/1972 | Bordonali et al. | |
| 3,726,297 A | * | 4/1973 | Heimann et al. | |
| 3,833,718 A | * | 9/1974 | Reed et al. | 366/162.4 |
| 3,852,013 A | | 12/1974 | Upmeier | 425/376 |
| 3,941,355 A | | 3/1976 | Simpson | 259/4 |
| 3,941,552 A | | 3/1976 | Cottell | 431/2 |
| 3,965,975 A | | 6/1976 | Edmundson | 165/108 |
| 4,081,863 A | | 3/1978 | Rees | 366/176 |
| 4,087,862 A | | 5/1978 | Tsien | 366/165 |
| 4,124,309 A | | 11/1978 | Yao | 366/340 |
| 4,159,881 A | | 7/1979 | Gogneau | 366/337 |
| 4,274,749 A | * | 6/1981 | Lake et al. | 366/173.1 |
| 4,299,498 A | | 11/1981 | Sauerbrunn | 366/76 |
| 4,337,161 A | | 6/1982 | Stayner | 252/49.5 |
| 4,440,500 A | | 4/1984 | Schneider | 366/177 |
| 4,452,917 A | | 6/1984 | Proksa et al. | 521/50 |
| 4,501,501 A | * | 2/1985 | Edwars | 366/336 |
| 4,533,254 A | | 8/1985 | Cook et al. | 366/176 |
| 4,597,671 A | | 7/1986 | Marelli | 366/127 |
| 4,634,574 A | * | 1/1987 | Spurlin et al. | |

(List continued on next page.)

FOREIGN PATENT DOCUMENTS

| | | | | |
|---|---|---|---|---|
| DE | 166309 | | 8/1925 | |
| DE | 1 457 146 | * | 12/1968 | 366/177.1 |
| EP | 0 568 070 A1 | | 3/1993 | B01F/5/06 |
| JP | 860 201 A2 | * | 8/1998 | 366/162.4 |

OTHER PUBLICATIONS

Jeffries et al., "Thermal Equilibrium During Cavitation" Science, vol. 256, No. 5054:248, Apr. 10, 1992.

Takamura et al., "The Influence of Cooling Rate on Emulsion Stability" Translation of Japanese article. Presented at 101st Japan Pharmaceutical Academy Confernce at Kumamoto, Apr. 1981.

Schubert et al., "Principles of Formation and Stability of Emulsions" International Chemical Engineering, vol. 32, No. 1, Jan. 1992, pp. 14–28. Federal Republic of Germany.

APV Gaulin Brochure, pp. 2–11.

*Primary Examiner*—Tony G. Soohoo
(74) *Attorney, Agent, or Firm*—Fish & Richardson P.C.

(57) ABSTRACT

Methods and apparatuses for processing product components. The methods include directing a first jet of fluid along a first path and directing a second jet of fluid along a second path to cause interaction between the jets that forms a stream oriented essentially opposite to one of the jet paths.

35 Claims, 6 Drawing Sheets

U.S. PATENT DOCUMENTS 4,701,055 A 10/1987 Anderson ..... 366/336
4,723,715 A 2/1988 Mazurkiewicz ..... 241/1
4,749,276 A * 6/1988 Bragg et al.
4,861,165 A * 8/1989 Fredriksson et al. ..... 366/336
4,989,988 A * 2/1991 Hutter et al.
5,035,362 A 7/1991 Mazurkiewicz ..... 241/1
5,147,412 A 9/1992 Klinksiek et al. ..... 23/293
5,176,448 A 1/1993 King et al. ..... 366/174.1
5,279,463 A 1/1994 Holl ..... 241/1
5,289,981 A 3/1994 Kamiwano et al. ..... 241/261.1
5,291,265 A * 3/1994 Kebabian ..... 356/246
5,366,287 A 11/1994 Verstallen ..... 366/173
5,380,089 A * 1/1995 Karasawa
5,427,181 A * 6/1995 Laskaris et al. ..... 366/336
5,482,369 A * 1/1996 Verstallen
5,720,551 A 2/1998 Shechter ..... 366/147
5,810,474 A * 9/1998 Hidalgo
5,820,256 A * 10/1998 Morrison ..... 366/162.4

* cited by examiner

PROCESSING PRODUCT COMPONENTS

BACKGROUND OF THE INVENTION

This invention relates to processing product components.

Product components can be intermixed to produce a wide variety of products having different physical characteristics. For example, a colloidal system may be a stable system comprising two immiscible substance phases with one phase dispersed as small droplets or particles in the other phase. Colloids may be classified according to the original phases of their constituents. For example, a solid dispersed in a liquid may be a dispersion. A semisolid colloidal system may be a gel. An emulsion may include one liquid dispersed in another.

For simplicity, we will call the dispersed phase "oil" and the continuous phase "water", although the actual product components may vary widely. Additional components may be included in a product such as emulsifying agents, known as emulsifiers or surfactants, that can stabilize emulsions and facilitate their formation by surrounding the oil phase droplets and separating them from the water phase.

As is described in U.S. Pat. No. 5,720,551, incorporated in its entirety, high pressure homogenizers are often used to intermix product components using shear, impact, and cavitation forces in a small zone. To prevent rapid wear to a high pressure homogenizer caused by different materials (e.g., relatively large solids), product components may be preprocessed by equipment such as ball mills and roll mills to reduce the size of such materials.

SUMMARY OF THE INVENTION

In general, in one aspect, a method of processing product components includes directing a first jet of fluid along a first path and directing a second jet of fluid along a second path. The paths are oriented to cause interaction between the jets that form a stream oriented essentially opposite to one of the jet paths.

Embodiments may include one or more of the following features. The first and second paths may oriented in essentially opposite directions. May be adjacent to one of the jets (e.g., a cylindrical stream surrounding one of the jets). The jets of fluid may be from a common fluid source. The jets may have identical or different jet characteristics. For example, the jets may have different velocities, for example, by ejecting the two jets at jet orifices of two different diameters.

In general, in another aspect, a method of processing product components includes directing a first jet of fluid from a common fluid source along a first path, directing a second jet of fluid from the common fluid source along a second path. The paths are oriented essentially opposite one another to cause interaction between the jets that forms a cylindrical stream surrounding one of the jets.

In general, in another aspect, a method of processing product components includes directing a first jet of fluid along a first path, directing a second jet of fluid along a second path, and causing sheer and cavitation in a third fluid by positioning the third fluid between the jets.

Embodiments may include one or more of the following features. The third fluid may include solids (e.g., powders, granules, and slurries). A gas may be used to position the third liquid.

In general, in another aspect, a method of processing product components includes directing a first jet of fluid formed from a common fluid source along a first path and directing a second jet of fluid formed from the common fluid source along a second path essentially opposite to the first path. The jets have different velocities and cause sheer and cavitation in a third fluid positioned between the jets. The jets form a stream oriented opposite one of the paths.

In general, in another embodiment, an apparatus for processing product components includes two nozzles configured to deliver jets of fluid along two different paths, and an elongated chamber that contains an interaction region in which the two paths meet. The chamber is configured to form a stream of fluid from the two jets that follows a path that has essentially the opposite direction from one of the paths of one of the jets.

Embodiments may include one or more of the following features. The apparatus may also include an outlet port configured to emit the stream. The nozzles may be aligned essentially opposite one another. The apparatus may also include an inlet port configured for receiving a second fluid. The inlet port may be aligned to position the second fluid such that the jets cause sheer and cavitation in the second fluid. The apparatus may also include a port that may be configured to be either an inlet port or an outlet port.

The chamber may include one or more reactors which may have different characteristics (e.g., inner diameter, contour, and composition). Seals may be positioned between the reactors. The seals may have different seal characteristics (e.g., inner diameter).

In general, in another aspect, an apparatus for processing product components includes two nozzles, aligned essentially opposite one another, configured to deliver respective jets of fluid along two different paths. The apparatus also includes an elongated chamber containing an interaction region in which the two paths meets. The chamber includes reactors and seals and is configured to form a stream of fluid from the two jets essentially the opposite direction from one of the paths of one of the jets. The apparatus further includes an outlet port configured to emit the stream.

Advantages of the invention may include one or more of the following. Very small liquid droplets or solid particles may be produced in the course of combining product components (e.g., emulsifying, mixing, blending, suspending, dispersing, de-agglomerating, or reducing the size of solid and/or liquid materials). Nearly uniform sub-micron or nano-size droplets or particles are produced. A broad range of product components may be used while maximizing their effectiveness by introducing them separately into the double-jet cell. Fine emulsions may be produced using fast reacting components by adding each component separately and by controlling the locations of their interaction. Control of temperature before and during product formation allows multiple cavitation stages without damaging heat sensitive components, by enabling injection of components at different temperatures and by injecting compressed air or liquid nitrogen prior to the final formation step. The effects of cavitation on the liquid stream are maximized while minimizing the wear effects on the surrounding solid surfaces, by controlling orifice geometry, materials selection, surfaces, pressure and temperature. A sufficient turbulence is achieved to prevent agglomeration before the surfactants can fully react with the newly formed droplets. Agglomeration after treatment is minimized by rapid cooling, by injecting compressed air or nitrogen, and/or by rapid heat exchange, while the emulsion is subjected to sufficient turbulence to overcome the oil droplets' attractive forces and maintaining sufficient pressure to prevent the water from vaporizing.

Scale-up procedures from small laboratory scale devices to large production scale systems is made simpler because process parameters can be carefully controlled. The invention is applicable to colloids, emulsions, microemulsions, dispersions, liposomes, and cell rupture. A wide variety of immiscible liquids may be used in a wide range of ratios. Smaller amounts of (in some cases no) emulsifiers are required. The reproducibility of the process is improved. A wide variety of products may produced for diverse uses such as food, beverages, pharmaceuticals, paints, inks, toners, fuels, magnetic media, and cosmetics. The apparatus is easy to assemble, disassemble, clean, and maintain. The process may be used with fluids of high viscosity, high solid content, and fluids which are abrasive and corrosive.

The emulsification effect continues long enough for surfactants to react with newly formed oil droplets. Multiple stages of cavitation assure complete use of the surfactant with virtually no waste in the form of micelles. Multiple ports along the process stream may be used for cooling by injecting components at lower temperature. VOC (volatile organic compounds) may be replaced with hot water to produce the same end products. The water will be heated under high pressure to well above the melting point of the polymer or resin. The solid polymer or resins will be injected in its solid state, to be melted and pulverized by the hot water jet. The provision of multiple ports eliminates the problematic introduction of large solid particles into the high pressure pumps, and requires only standard industrial pumps. The invention also enables particle size reduction of extremely hard materials (e.g., ceramic and carbide powders).

Other advantages of the invention will become apparent in view of the following description, including the figures, and the claims.

DESCRIPTION OF THE PREFERRED EMBODIMENTS

Figure 1:
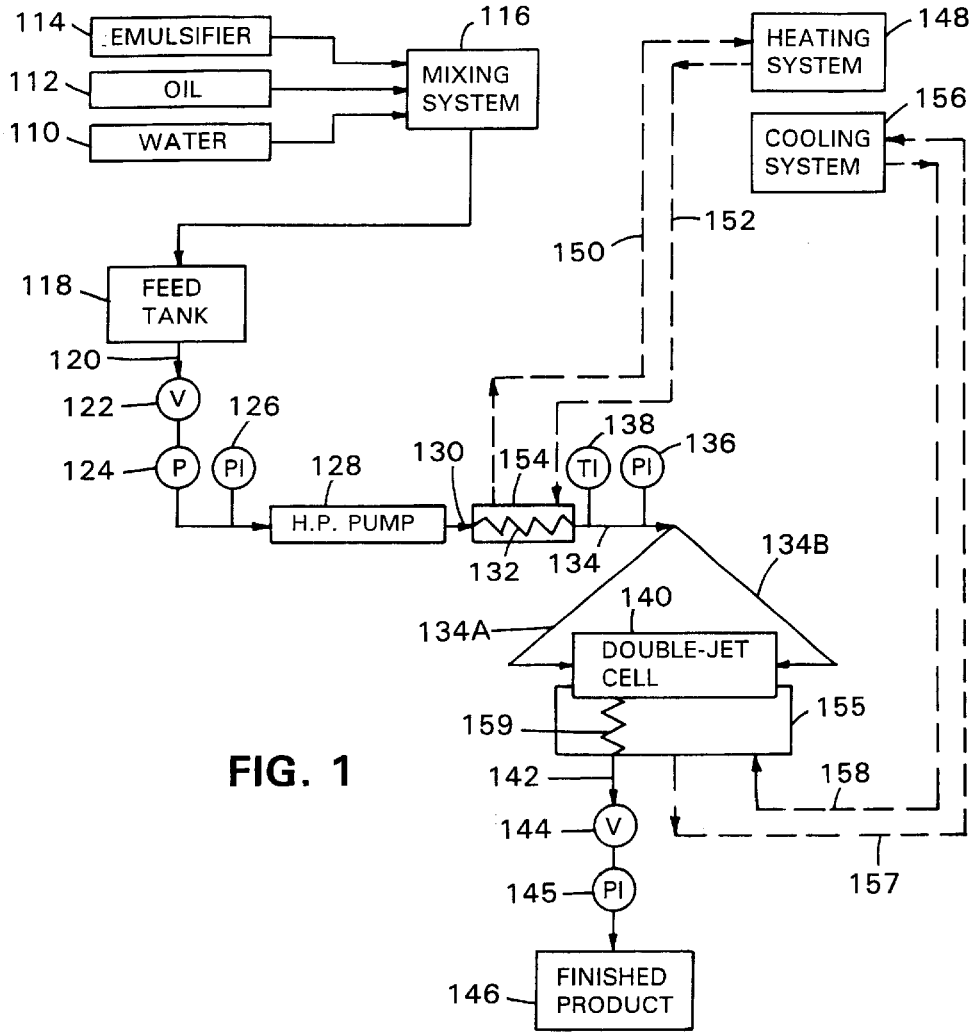
FIGS. 1 through 3 are block diagrams of emulsification systems.

In FIG. 1, product components are supplied from sources 110, 112, and 114 into a pre-mixing system 116. For simplicity, only three types of components are shown by way of example: water, oil, and emulsifier; but a wide variety of other components, or more than three components, could be used depending on the product to be made. The pre-mixing system 116 is of a suitable kind (e.g. propeller mixer, colloid mill, homogenizer, etc.) for the type of product. After pre-mixing, the components are fed into a feed tank 118. In some cases, the pre-mixing may be performed inside feed tank 118. The pre-mixed product from tank 118 then flows through line 120 and valve 122 by means of transfer pump 124 to a high pressure process pump 128. Transfer pump 124 may be any type of pump normally used for the product, provided it can generate the required feed pressure for proper operation of the high pressure process pump. Pressure indicator 126 is provided to monitor feed pressure to pump 128. The high pressure process pump 128 is typically a positive displacement pump, e.g., a triplex or intensifier pump. From process pump 128 the product flows at high pressure through line 130 into coil 132 where pressure fluctuations generated by the action of pump 128 are regulated by expansion and contraction of coil tubing. It may be desirable or necessary to heat or cool the feed stock. Heating system 148 may circulate hot fluid in shell 154 via lines 150 and 152, or cooling system 156 may be used. The heating medium may be hot oil or steam with the appropriate means to control the temperature and flow of the hot fluid such that the desired product temperature is attained upon exiting coil 132. The product exits coil 132 through line 134, where pressure indicator 136 and temperature indicator 138 monitor these parameters. Line 134 splits into lines 134A and 134B to lead the product into double-jet cell 140 from both ends, such that each of the two nozzles in cell 140 is supplied with product at high pressure, for example a pressure of 15,000 psi.

Processing of the product components, e.g., to form a colloid system, takes place in double-jet cell 140 where the feed stock is forced through two jet generating orifices and through an absorption cell wherein the jets are forced to flow in close proximity and in essentially opposite directions, thereby causing the jets' kinetic energy to be absorbed by the fluid streams. In each of the treatment stages (there may be one or more), intense forces of shear, impact, and/or cavitation break down the oil phase into extremely small and highly uniform droplets, and allow sufficient time for an emulsifier to interact with these small oil droplets to stabilize the emulsion. Before exiting the absorption cell, the processed product is forced to flow in close proximity to one of the jets which impels some of the processed product back into the absorption cell, thereby effecting repeated cycles of processing.

Immediately following the emulsification process the product flows through line 159 which may be a coil or other structure to effect rapid cooling. Cooling system 156 may circulate cold fluid in bath or shell 155 via lines 157 and 158. The cooling fluid may be water or other fluids with the appropriate means to control the temperature and flow of the coolant such that the desired cooling rate and product temperature is attained. The product exits the cooler through line 142 where metering valve 144 and pressure indicator 145 are provided to control and monitor back-pressure during cooling and ensure that the hot emulsion remains in a liquid state while being cooled, thereby maintaining the emulsion integrity and stability. Finally, the finished product is collected in tank 146.

Figure 2:
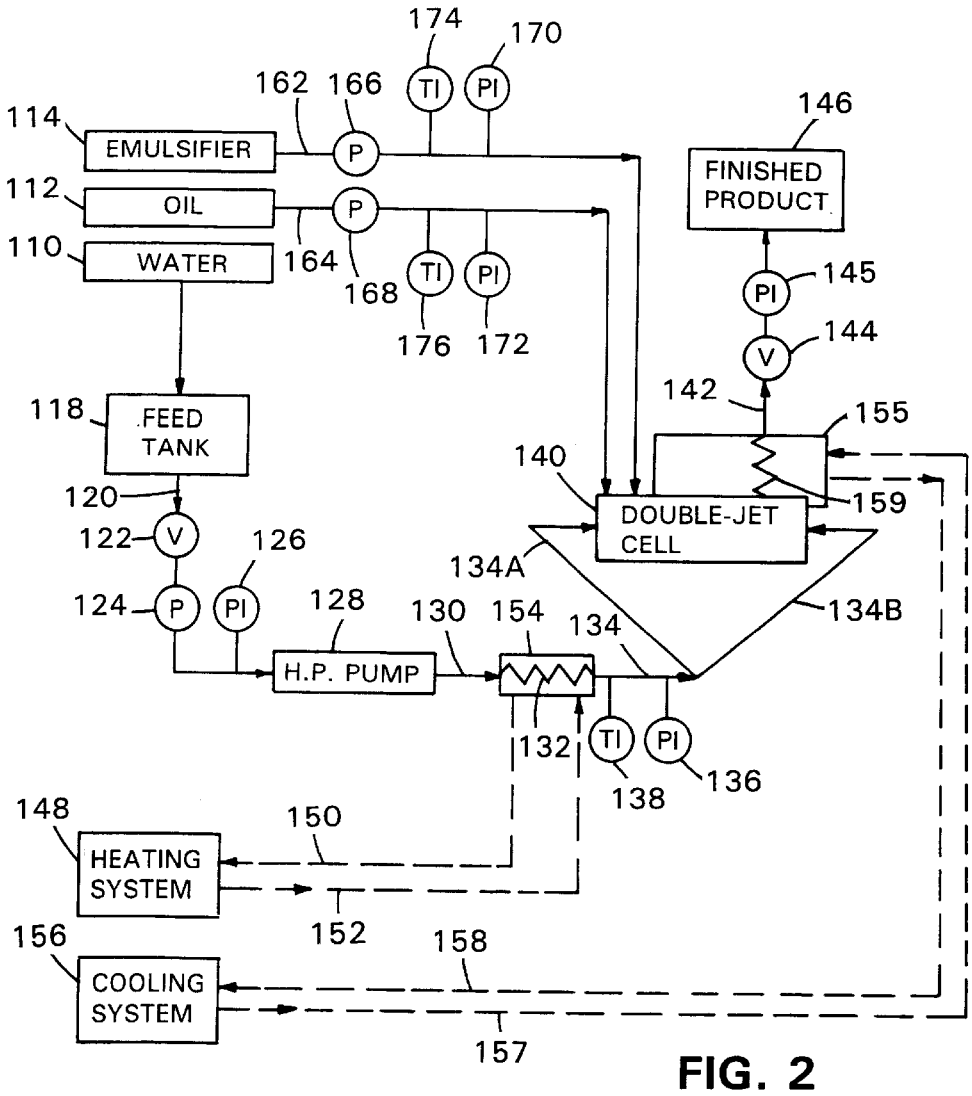

In the system illustrated in FIG. 2, one or more product components are supplied from supply 110 into feed tank 118, while other components are supplied from sources 112 and 114 directly into double-jet cell 140. For simplicity and by way of example, water is fed into H.P. pump 128 while oil and emulsifier are fed directly into cell 140; but a wide variety of other components could be used depending on the product to be made. Water may be the continuous phase or the discontinuous phase depending on its ratio to oil. Typically, components that would be fed directly into cell 140 are materials that could not flow through the H.P. pump 128 and/or through the orifice inside cell 140 because they are too viscous and/or abrasive (e.g., resins, polymers, Alumina ceramic powder). Some components may be mixed together to reduce the number of separate feed lines, or there may be as many feed lines as product components.

Water from tank 118 flows through line 120 and valve 122, by means of transfer pump 124 to the H.P. pump 128. Elements 128 through 138 and 148 through 158 have similar functions to the same numbered elements of the system of FIG. 1.

Oil and emulsifier, each representing a possibly unlimited number and variety of components which may be introduced separately, flow from sources 112 and 114 into double-jet cell 140 through lines 162 and 164, each line having a pressure indicator 170 and 172 and a temperature indicator 174 and 176, by means of metering pumps 166 and 168. Metering pumps 166 and 168 are suitable for the type of product pumped (e.g. sanitary cream, injectable suspension, abrasive slurry) and the required flow and pressure ranges. For example, in small scale systems peristaltic pumps are used, while in production system and/or for high pressure injection, diaphragm or gear pumps are used.

Inside double-jet cell 140 the water is forced through two orifices creating two water jets. Other product components, as exemplified by the oil and emulsifier, are injected into double-jet cell 140. The interaction between the extremely high velocity water jet at one end of double-jet cell 140 and the stagnant components from lines 162 and 164 subjects the product to a series of treatment stages. In each stage intense forces of shear, impact, and/or cavitation break down the oil and emulsifier to extremely small and highly uniform droplets, and allows sufficient time for the emulsifier to interact with the oil droplets. After the interaction between the water jet at one end of double-jet cell 140 and the components from lines 162 and 164, the processed mixture meets the second water jet of the other end of double-jet cell 140. The second water jet generates additional forces of shear, impact, and/or cavitation to further reduce the size of oil droplets and increase their uniformity. The second water jet also carries some of the processed product back into the absorption cell thereby effecting repeated cycles of processing. Immediately following the emulsification process, the emulsion is cooled and then exits the double-jet cell 140 and is collected, all in a manner similar to the one used in the system of FIG. 1.

Figure 3:
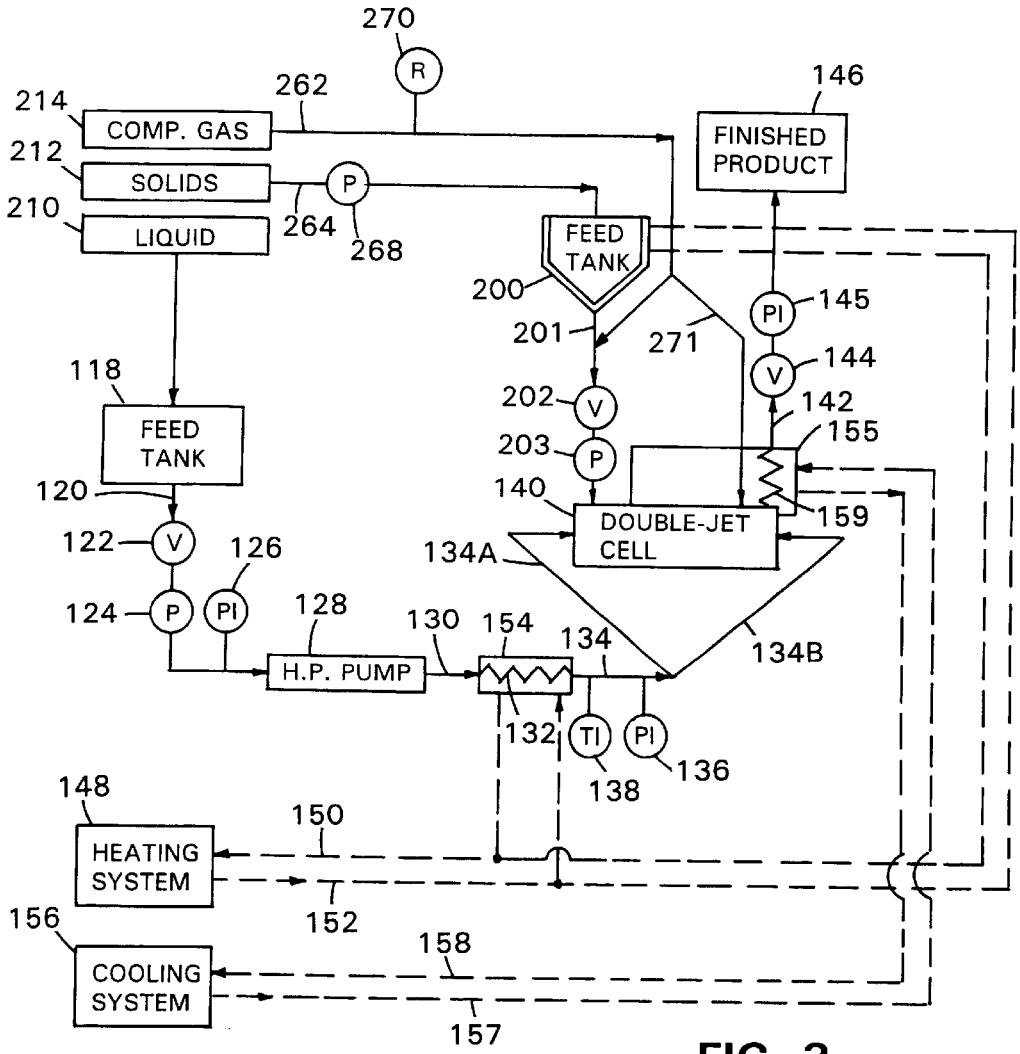

In the system illustrated in FIG. 3, a product's liquid phase is supplied from supply 210 into feed tank 118, while a solid phase is supplied from source 212 into feed tank 200. Compressed gas source 214 may be used to facilitate solids flow and/or to effect cooling inside double-jet cell 140.

Liquid from tank 118 flows through line 120 and valve 122 by means of transfer pump 124 to the high pressure process pump 128. Elements 128 through 138 and 148 through 158 have similar functions to the same numbered elements of the system in FIG. 1.

Solids, representing a possibly unlimited number and variety of materials in various states (dry powders, granules, slurries, etc.), may be introduced separately through line 264 by means of transfer pump 268 into feed tank 200. Transfer pump 268 may be selected for the type and state of the solids. For example, dry powders may be fed with a screw pump while granules or slurries may be fed with a diaphragm pump. The solids may be melted if necessary in feed tank 200 by means of heating system 148 and lines 150 and 152. Such heating may be required for melting materials such as resins or polymers. Solids from tank 200 flow through line 201 and valve 202 by means of metering pump 203 into double-jet cell 140. Metering pump 203 is suitable for the type of solids pumped and the required flow and pressure ranges. For solids that should be introduced in dry powder form, compressed gas 214 is supplied. Compressed gas (such as air or Nitrogen) from source 214 flows through line 262 and is regulated by regulator 270. Gas flow into the feed tank discharge line 201 facilitates and regulates the flow of powder into double-jet cell 140.

Inside double-jet cell 140 the liquid phase is forced through two dissimilar orifices, creating two dissimilar jets. The orifices are dissimilar in such a way to create a vacuum in one end of the cell and positive pressure in the other end. For example, one orifice is made larger then the other. The jet from the larger orifice creates a vacuum before entering the absorption cell and creates positive pressure at the other end of the absorption cell. The solid phase is injected into double-jet cell 140 at a point where the liquid jet has generated the vacuum.

The interaction between the extremely high velocity liquid jet at one end of double-jet cell 140 and the stagnant solids line 201 subjects the product to a series of treatment stages. In each stage intense forces of shear, impact, and/or cavitation break down the solids to extremely small and highly uniform particles (or droplets if in melted form), and allows sufficient time for the emulsifier to interact with the solids particles and/or droplets. After the interaction between the first liquid jet at one end of double-jet cell 140 and the solids from line 201, the processed mixture meets the second liquid jet from the other end of double-jet cell 140. The second liquid jet generates additional intense forces of shear, impact, and/or cavitation to further reduce the size of solid particles/droplets and increase their uniformity. The second liquid jet also carries some of the processed product back into the absorption cell, thereby effecting repeated cycles of processing. Immediately following this process, the processed product is cooled, exits the double-jet cell 140, and is collected, all in a manner similar to the one used in the system of FIG. 1. Alternatively, compressed gas through line 271 may be fed into double-jet cell 140 to effect rapid cooling. The decompression of the gas inside cell 140 is coupled with rapid cooling of the gas and thus of the product.

Figure 4:
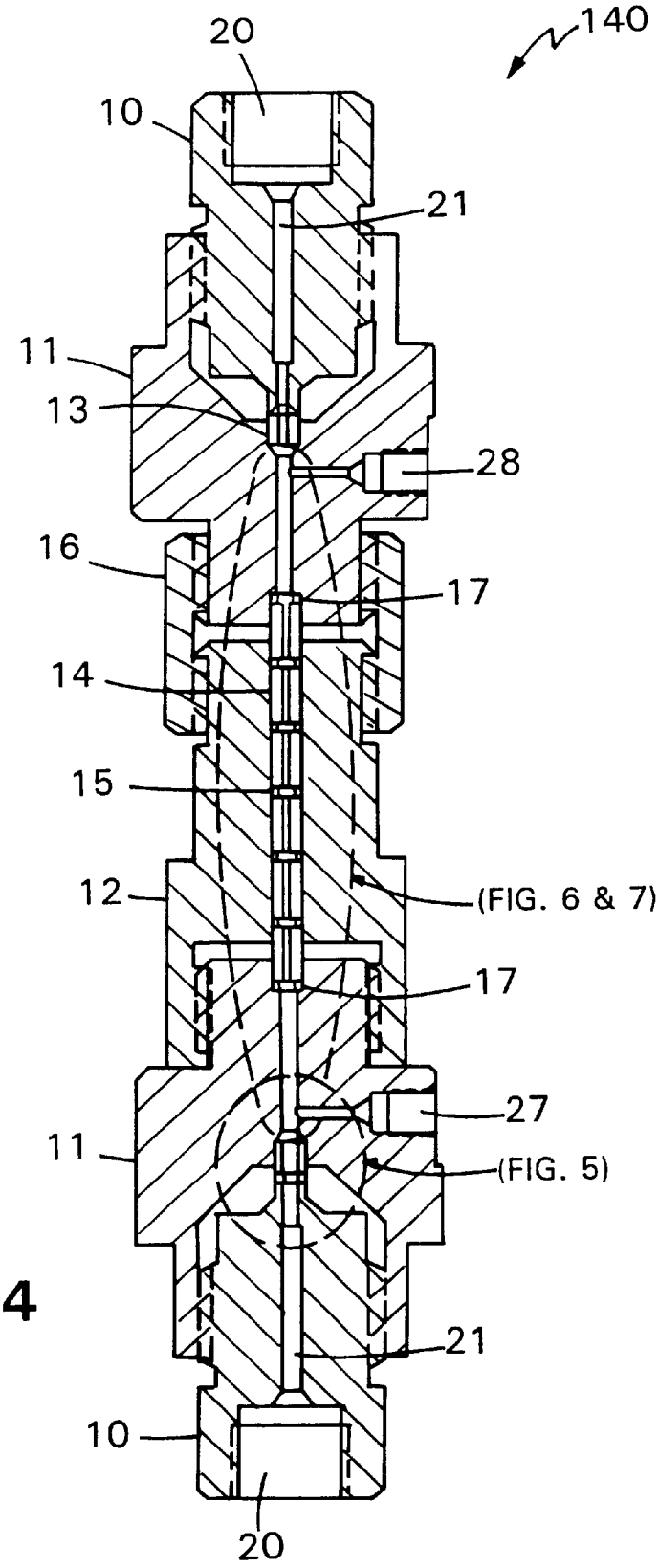
FIG. 4 is a cross-sectional view of a double-jet cell assembly.
Figure 5:
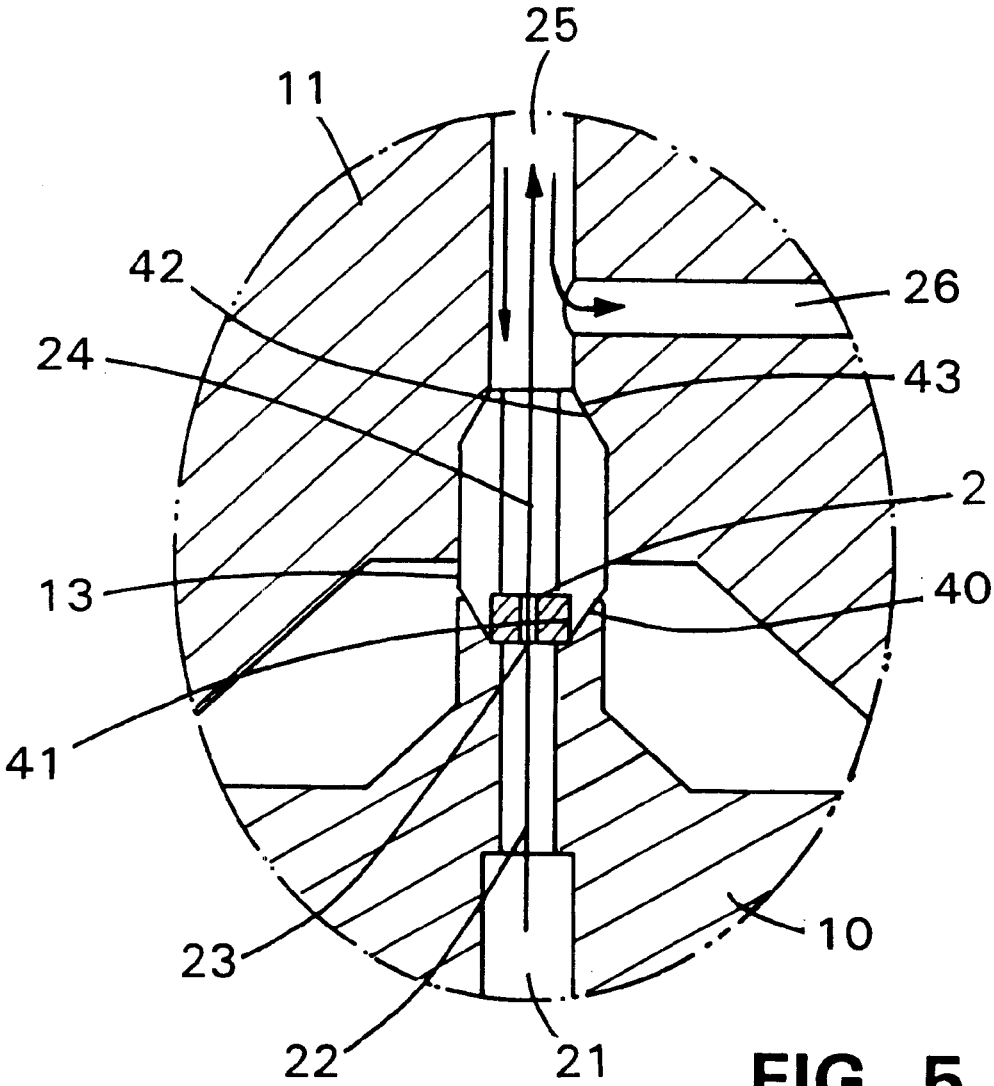
FIG. 5 is an enlarged cross-sectional view of an orifice of the double-jet cell assembly.

As seen in FIG. 4, the double-jet cell 140 is constructed using a series of pieces. In the example of a basic double-jet cell in FIG. 4 there are two (identical) inlet fittings 10, two bodies 11, retainer 12, and coupling 16. In one end of each inlet fitting 10, a standard high pressure port 20 is provided, for example ⅜" H/P (e.g. Autoclave Engineers #F375C). The other end of each inlet fitting 10 makes a pressure containing metal-to-metal seal with a nozzle 13. Referring also to FIG. 5, sealing surface 40 of nozzle 13 fits into sealing surface 41 of inlet fitting 10, while sealing surface 42 of nozzle 13 fits into sealing surface 43 in body 11, making pressure containing metal-to-metal sealing between members 10, 13 and 11 upon fastening inlet fitting 10 into body 11. Nozzle 13 is press-fitted with a ceramic insert 2 which contains orifice 23. An absorption cell 17 is constructed using a series of reactors 14 and seals 15 held within a lumen of retainer 12 and the ends of the bodies 11. Reactors 14 are made of an abrasion resistant material such as ceramic or stainless steel depending on product abrasiveness and the reactor lumen inner diameter (e.g. 0.02 inch to 0.12 inch). Seals 15 are made of plastic unless the process requires elevated temperature, in which case other materials such as stainless steel may be used. Upon fastening simultaneously bodies 11 at the two ends of double-jet cell 140, the series of reactors 14 and seals 15 form a pressure containing absorption cell. Ports 27 and 28 are standard ¼" M/P (e.g. Autoclave Engineers #F250). The function of ports 27 and 28 varies depending on the system configuration (FIGS. 1 through 3).

In the type of system shown in FIG. 1, port 27 functions as the discharge port of double-jet cell 140 while port 28 is plugged. Pre-mixed components are fed into the double-jet cell through ports 20 at both ends of the double-jet cell, flow through round openings 21 (e.g. ⅛" dia. hole), and flow through round openings 22 (e.g. 1/16" dia. hole). The product liquid is then forced by high pressure through orifice 23. The diameter of orifice 23 determines the maximum attainable pressure for any given flow rate. For example, a 0.015 in. dia. hole will enable 10,000 psi with a flow rate of 1 liter/min. of water. More viscous fluids require an orifice opening as large as 0.032 in. dia. to attain the same pressure and flow rate, while smaller systems with pump capacity under 1 liter/min. require an orifice as small as 0.005 in dia. to attain 10,000 psi. The high velocity jet is ejected from orifice 23 into opening 24 (e.g. 1/16" dia. hole) in nozzle 13 and then into opening 25 (e.g. 3/32" dia. hole) in body 11. Opening 25 in body 11 communicates with round opening 26 (e.g. 3/32" dia.) in body 11. Processing of the product begins in orifices 23 at both ends of the double-jet cell, where the product is accelerated to a velocity exceeding 500 ft/sec. upon entering orifices 23. This sudden acceleration which occurs simultaneously with a severe pressure drop causes cavitation in the orifice. Cavitation, as well as shear due to the extremely high differential velocity in the orifice, cause break down of the discontinuous phase droplets or particles.

Figure 6:
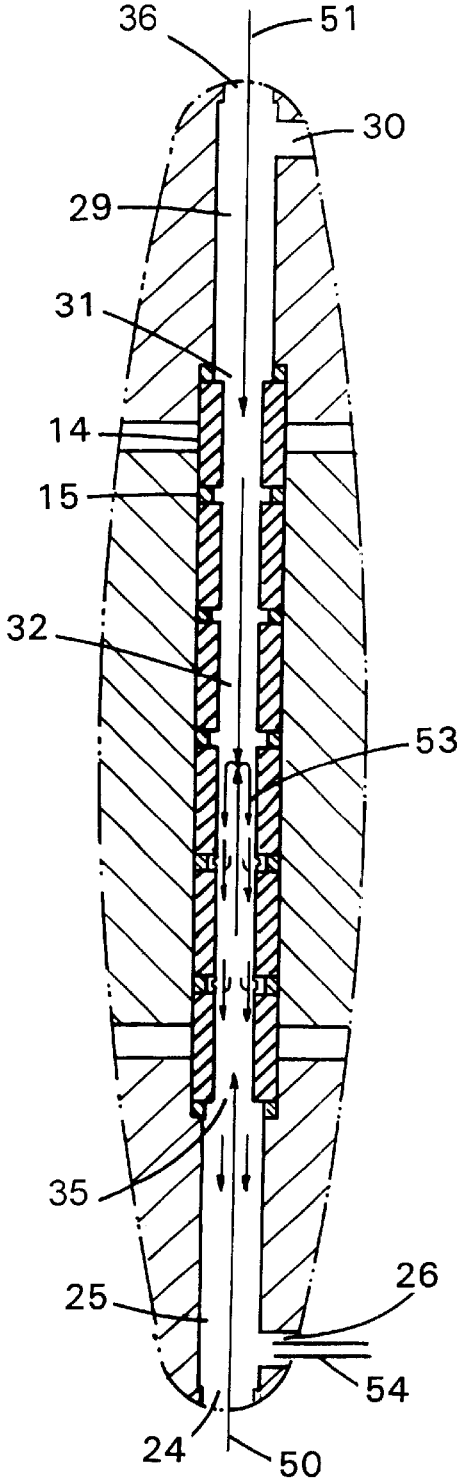
FIGS. 6 and 7 are schematic cross-sectional diagrams, not to scale, of fluid flow in an absorption cell.

Referring now to FIG. 6, coherent jet stream 50 formed in orifice 23 is maintained essentially unchanged as it flows through openings 24, 25 and 35 in one end of double-jet cell 140 while coherent jet 51 is maintained essentially unchanged as it flows through openings 36, 29 and 31 in the other end of cell 140. Jet 50 enters the absorption cell through opening 27, while jet 51 enters the other end of the absorption cell through opening 31. The two jet streams 50 and 51 impact each other in cavity 32 and form a coherent flow stream 53. The coherent flow pattern is formed and flows in the direction of exit cavity 32. Stream 53 exits cavity 32 through opening 35 and ejects into opening 25. Finally, the processed product 54 exits dual-jet cell 140 through opening 26 and opening 35.

The absorption cell geometry may be easily varied to intensify or curtail the forces of shear, impact and/or cavitation that act on the product. Jet velocity is determined by the size and shape of orifices 23 and by the pressure setting of the H.P pump 128. The velocity of coherent stream 53 is determined by the inner diameter of reactors 14. Coherent stream 53 may flow in laminar or turbulent flow patterns, depending on the inner diameter of seals 15. When seals 15 have the same inner diameters as reactors 14 (not shown), stream 53 will be laminar. When seals 15 have larger inner diameters than reactors 14 (shown), stream 53 will be turbulent. Large reactor inner diameters with laminar flow may be used to effect a more gentle process for products sensitive to shear or cavitation. Smaller reactor inner diameters with turbulent flow may be used to effect intense shear, repeated stages of cavitation, and impact through repeated interaction. The process may be made gradual or with several stages of increasing or decreasing process intensity by assembling various sizes of reactors 14 and seals 15. Process duration may be easily determined by the number of reactors 15. Retainer 12 is made with male and female threads of the same size. This enables connecting one, two, or three retainers (not shown) in a single dual-jet cell assembly which in turn enables use of different numbers of reactors (e.g., one to twenty).

In the type of system shown in FIG. 2, port 27 functions as inlet port for the oil phase, while port 28 functions as the discharge port of double-jet cell 140. Water phase is fed into the double-jet cell 140 through ports 20 at both ends of cell 140 and is forced by high pressure through orifices 23 in a manner similar to the one used in the system of FIG. 4.

Figure 7:
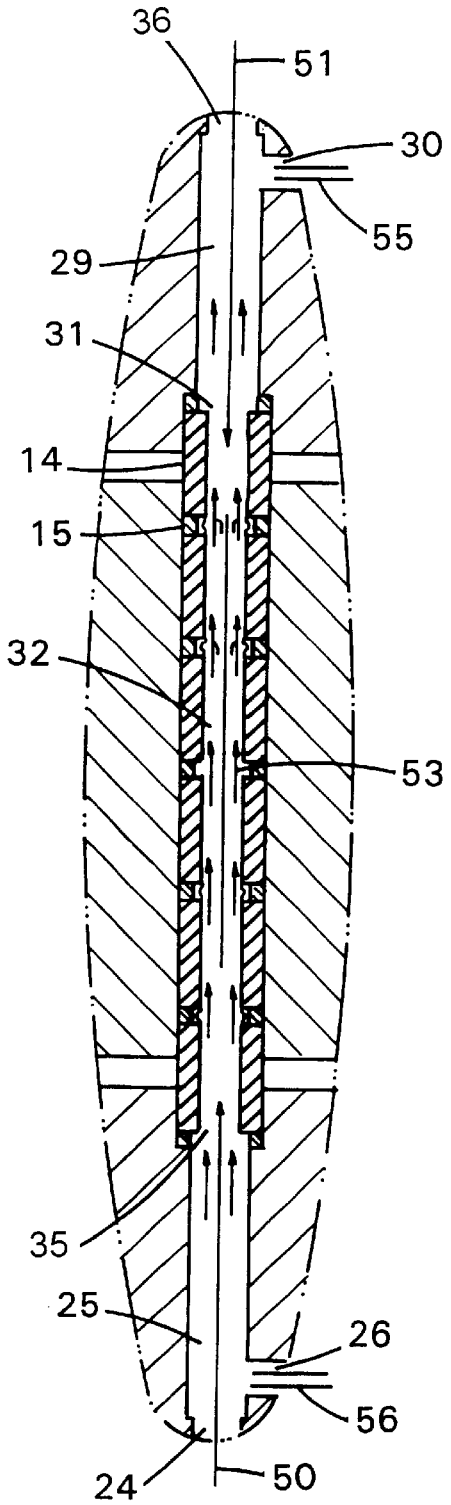

Referring now to FIG. 7, in the system shown in FIG. 2, jet stream 50 is maintained essentially unchanged as it flows through openings 24 in one end of the double-jet cell while jet 51 is maintained essentially unchanged as it flows through openings 28 in the other end of the double-jet cell. Jet 50 is made more intense than jet 51 by using a larger orifice to generate jet 50 than to generate jet 51. Since both ends of double-jet cell 140 are subjected to the same pressure, the flow rate through the larger orifice is higher then through the smaller orifice. The two jet streams 50 and 51 impact each other in cavity 32 and form a coherent flow stream 53. Because jet 50 is more intense than jet 51, coherent stream 53 exits the double-jet cell through opening 30 and port 28. Because jet 50 flows uninterrupted and at a very high velocity through opening 25, vacuum develops in opening 25. The vacuum facilitates flow of oil through port 27 and opening 26.

The process begins when the high velocity jet 50 meets the much lower velocity stream 56 of oil. The high differential velocity between jet 50 and stream 56 generates intense shear forces. Depending on local temperature, relative velocity and vapor pressure of the two phases, cavitation may be effected in opening 25 due to hydraulic separation. The process continues in cavity 32 where the impact between the two jets and the interaction between coherent stream 53 and jet 51 effect intense and controllable mixing in a manner similar to the one used in the system of FIG. 6.

Stream 53 exits cavity 32 through opening 31 and ejects into opening 29. Finally, the processed product 55 exits dual-jet cell 140 through opening 30 and port 28.

In the type of system shown in FIG. 3, port 27 functions as an inlet port for the solids phase, while port 28 functions as the discharge port of double-jet cell 140. The liquid phase is fed into the double-jet cell 140 through ports 20 at both ends of the double-jet cell 140 and is forced by high pressure through orifice 23 in a manner similar to the one used in the system of FIG. 4. The liquid phase may be the continuous or discontinuous phase depending on the relative flow rates of solids and liquid. Processing in the double-jet cell 140 is in a manner similar to the one used in the system of FIG. 7. The ability to introduce components directly into the double-jet cell, bypassing the H.P pump and orifices, enables processing of extremely viscous and/or abrasive materials. This feature is particularly useful for replacing a common use of VOC. The interaction between two high velocity jets 50 and 51, and the repeated interaction between the coherent stream 53 and jet 51, enable particle size reduction of extremely hard materials such as ceramic and carbide powders.

Other embodiments are within the scope of the following claims.

What is claimed is:

1. An apparatus for processing product components comprising, two nozzles configured to deliver respective jets of liquid along two different substantially opposite and substantially co-linear paths, and an elongated confinement chamber configured to receive the respective jets of liquid at opposite ends thereof and in which the two paths meet, the confinement chamber being configured to form a stream of fluid from the two jets of liquid, the stream of fluid following a path that is in substantially the opposite direction from one of the paths of one of the jets of liquid so that the stream of fluid interacts with one of the jets of liquid within the elongated confinement chamber.

2. The apparatus of claim 1, further comprising an outlet port configured to emit the stream.

3. The apparatus of claim 1, wherein the nozzles are aligned opposite one another.

4. The apparatus of claim 1, further comprising an inlet port configured for receiving a second fluid, the inlet port aligned to position the received second fluid such that the jets cause sheer and cavitation in the second fluid.

5. The apparatus of claim 1, further comprising a port that may be configured to be either an inlet port or an outlet port.

6. The apparatus of claim 1, wherein the elongated confinement chamber comprises one or more cylindrical reactors.

7. The apparatus of claim 6, wherein the one or more cylindrical reactors are interchangeable with other reactors having a different reactor characteristic.

8. The apparatus of claim 7, wherein the reactor characteristic comprises reactor inner diameter.

9. The apparatus of claim 7, wherein the reactor characteristic comprises reactor contour.

10. The apparatus of claim 7, wherein the reactor characteristic comprises a reactor material composition selected from the group consisting of ceramic and stainless steel.

11. The apparatus of claim 6, further comprising at least one seal positioned between the one or more cylindrical reactors.

12. The apparatus of claim 11, wherein the at least one seal is interchangeable with other seals having a different seal characteristic.

13. The apparatus of claim 12, wherein a seal characteristic comprises seal diameter.

14. The apparatus of claim 1, wherein the nozzles and the elongated confinement chamber are configured so that the jets of liquid operate at about 10,000 psi or greater.

15. The apparatus of claim 1, wherein the nozzles and the elongated confinement chamber are configured so that the jets of liquid have a velocity of about 500 ft/sec or greater.

16. The apparatus of claim 1, wherein the elongated confinement chamber is a cylindrical, pressure containing, open cavity cell.

17. The apparatus of claim 1, wherein the elongated confinement chamber comprises a plurality of reactors, and seals disposed between the reactors.

18. The apparatus of claim 1, wherein the elongated confinement chamber comprises a combination of reactors and seals that can be altered to vary the processing forces imparted on the processed product.

19. The apparatus of claim 18, wherein one of the seals has a larger inner diameter than an inner diameter of an adjacent reactor.

20. The apparatus of claim 18, wherein one of the seals has a smaller inner diameter than an inner diameter of an adjacent reactor.

21. The apparatus of claim 18, wherein one of the seals has an inner diameter identical to an inner diameter of an adjacent reactor.

22. The apparatus of claim 1, wherein the elongated confinement chamber comprises a reactor having an inside diameter between about 0.015 and 0.25 inch.

23. The apparatus of claim 1, wherein the elongated confinement chamber comprises a reactor having an outside diameter between about 0.25 and 0.5 inch.

24. The apparatus of claim 1, wherein the nozzles, elongated confinement chamber and cell are configured so that the stream of fluid follows a path that is in substantially the opposite direction from one of the paths of one of the jets.

25. The apparatus of claim 1, wherein the cell comprises a reactor having a length of about 0.5 inch.

26. An apparatus for processing product components, comprising two nozzles aligned opposite one another and configured to deliver respective jets of liquid along two different substantially opposite and substantially co-linear paths, an elongated confinement chamber disposed between the two nozzles to receive the respective jets of liquid at opposite ends thereof, the chamber including reactors and seals, the confinement chamber being configured to form a stream of fluid from the two jets of liquid, the stream of fluid following a path that is in substantially the opposite direction from one of the paths of one of the jets of liquid so that the stream of fluid interacts with one of the jets of liquid within the elongated confinement chamber.

27. The apparatus of claim 26, further comprising an inlet port configured for receiving a second fluid, the inlet port aligned to position the received second fluid such that the jets cause sheer and cavitation in the second fluid.

28. The apparatus of claim 26, wherein the nozzles, elongated confinement chamber and cell are configured so that the stream of fluid follows a path that is in substantially the opposite direction from one of the paths of one of the jets.

29. The apparatus of claim 26, wherein the cell comprises at least one reactor and at least one seal.

30. The apparatus of claim 29, wherein an inner diameter of the at least one seal is larger than an inner diameter of the at least one reactor.

31. The apparatus of claim 29, wherein an inner diameter of the at least one seal is smaller than an inner diameter of the at least one reactor.

32. The apparatus of claim 29, wherein an inner diameter of the at least one seal is identical to an inner diameter of the at least one reactor.

33. The apparatus of claim 26, wherein the cell comprises a reactor having an inside diameter between about 0.015 inch and about 0.25 inch.

34. The apparatus of claim 26, wherein the cell comprises a reactor having an outside diameter between about 0.25 and about 0.5 inch.

35. The apparatus of claim 26, wherein the cell comprises a reactor having a length of about 0.5 inch.

* * * * *